US006077367A

United States Patent [19]

Mizushima et al.

[11] Patent Number: 6,077,367

[45] Date of Patent: Jun. 20, 2000

[54] METHOD OF PRODUCTION GLASSY ALLOY

[75] Inventors: Takao Mizushima; Akihiro Makino, both of Niigata-ken; Akihisa Inoue, 11-806 Kawauchijutaku, 35 Motohasekura, Aoba-ku, Sendai-shi, Miyagi-ken, all of Japan

[73] Assignees: Alps Electric Co., Ltd., Tokyo; Akihisa Inoue, Miyagi, both of Japan

[21] Appl. No.: 09/025,963

[22] Filed: Feb. 19, 1998

[30] Foreign Application Priority Data

Feb. 19, 1997 [JP] Japan ..... 9-035342

[51] Int. Cl.[7] ..... C22C 45/02

[52] U.S. Cl. ..... 148/561; 148/304

[58] Field of Search ..... 148/304, 403, 148/561; 420/8, 14

[56] References Cited

U.S. PATENT DOCUMENTS

| | | | |
|---|---|---|---|
| 4,482,402 | 11/1984 | Taub | 148/304 |
| 4,859,256 | 8/1989 | Sawa et al. | 148/304 |
| 5,738,733 | 4/1998 | Inoue | 148/304 |

FOREIGN PATENT DOCUMENTS

| | | |
|---|---|---|
| 0747498 | 12/1996 | European Pat. Off. . |
| 3023604 A1 | 1/1981 | Germany . |

OTHER PUBLICATIONS

German book "Einführung in die Werkstoffwissenschaft" (Introduction to Materials Science), publisher Werner Schatt, 6th edition, Leipzig 1987.

*Primary Examiner*—George Wyszomierski
*Attorney, Agent, or Firm*—Brinks Hofer Gilson & Lione

[57] ABSTRACT

The present invention provides a method of producing a glassy alloy which has soft magnetism at room temperature and high resistivity and which can be easily obtained in a bulk shape thicker than an amorphous alloy ribbon obtained by a conventional melt quenching method. In this method, a melted metal having a supercooled liquid temperature width $\Delta T_x$ of 35° C. or more, which is expressed by the equation $\Delta T_x = T_x - T_g$ (wherein $T_x$ indicates the crystallization temperature, and $T_g$ indicates the glass transition temperature), is sprayed on a cooling body under movement to form a ribbon-shaped glassy alloy material; and the glassy alloy is then heat-treated by heating at a heating rate of 0.15 to 3° C./sec and then cooling.

7 Claims, 10 Drawing Sheets

METHOD OF PRODUCTION GLASSY ALLOY

BACKGROUND OF THE INVENTION

1. Field of the Invention

The present invention relates to a method of producing a glassy alloy, and particularly to a technique capable of obtaining a glassy alloy having a thickness significantly larger than conventional amorphous alloy ribbons, excellent magnetic properties and high resistivity.

2. Description of the Related Art

Some of conventional multi-element alloys are known to have a wide temperature region in a supercooled liquid state before crystallization, and constitute glassy alloys. Such glassy alloys are also known to become bulk-shaped alloys significantly thicker than amorphous alloy ribbons produced by a conventional known melt quenching method.

Examples of such conventional known glassy alloys include alloys having the compositions of Ln—Al—TM, Mg—Ln—TM, Zr—Al—TM, Hf—Al—TM, Ti—Zr—Be—TM (wherein Ln indicates a rare earth element, and TM indicates a transition metal), and the like.

However, all these conventional known glassy alloys have no magnetism at room temperature, and from this viewpoint, such glassy alloys have a large industrial limit when considered as magnetic materials.

Therefore, research and development have conventionally progressed for obtaining an amorphous alloy which has magnetism at room temperature and which can be obtained in a thick bulk shape.

Although alloys having various compositions exhibit a supercooled liquid region, the temperature width $\Delta T_x$ of the supercooled liquid region, i.e., the difference between the crystallization temperature ($T_x$) and the glass transition temperature ($T_g$), i.e., the value of ($T_x$–$T_g$), is generally small, and these alloys have the low ability to form an amorphous phase and are thus impractical. Considering this property, an alloy which has a wide supercooled liquid temperature region, and which can form a glassy alloy by cooling can overcome a limit to the thickness of a conventional known amorphous alloy ribbon, and thus the alloy should attract much attention from a metallurgical stand point. However, whether such an alloy can be developed as an industrial material depends upon discovery of an amorphous alloy exhibiting ferromagnetism at room temperature.

In consideration of the above background, the inventors previously found a glassy alloy having ferromagnetism at room temperature, and filed application for a patent in the specification of Japanese Patent Application No. 8-243756. However, as a result of repetitions of research on a method of producing such a glassy alloy exhibiting ferromagnetism at room temperature, the inventors achieved the present invention.

SUMMARY OF THE INVENTION

In consideration of the above background, an object of the present invention is to provide a method of producing a glassy alloy which has soft magnetism at room temperature and high resistivity and which can be easily obtained in a bulk shape having a larger thickness than amorphous alloy ribbons obtained by the conventional melt quenching method.

In order to achieve the object, the present invention provides a method of producing a glassy alloy comprising spraying, on a cooling body under movement, a melted metal having a supercooled liquid temperature width $\Delta T_x$ of 35° C. or more expressed by the equation $\Delta T_x = T_x - T_g$ (wherein $T_x$ indicates the crystallization temperature, and $T_g$ indicates the glass transition temperature), to form a ribbon-shaped glassy alloy material, and heat-treating the glassy alloy material by heating at a heating rate of 0.15 to 3° C./sec. and then cooling.

In the present invention, the heating temperature of heat treatment is preferably in the range of the crystallization start temperature to the glass transition temperature.

In the present invention, the cooling rate of the heat treatment is preferably 0.02 to 500° C./sec.

In the present invention, as the glassy alloy, an alloy having a composition comprising 1 to 10 atomic % of Al, 0.5 to 4 atomic % of Ga, 9 to 15 atomic % of P, 5 to 7 atomic % of C, 2 to 10 atomic % of B, and the balance comprising Fe can be used.

In the present invention, as the glassy alloy, an alloy having a composition comprising 1 to 10 atomic % of Al, 0.5 to 4 atomic % of Ga, 9 to 15 atomic % of P, 5 to 7 atomic % of C, 2 to 10 atomic % of B, 0 to 15 atomic % of Si, and the balance comprising Fe can be used.

In the present invention, as the glassy alloy, an alloy having the above composition to which 0 to 4 atomic % of Ge is further added can be used.

In the present invention, as the glassy alloy, an alloy having the above composition to which not more than 7 atomic % of at least one of Nb, Mo, Hf, Ta, W, Zr and Cr is further added can also be used.

In the present invention, as the glassy alloy, an alloy having the above composition to which at least one of not more than 10 atomic % of Ni and not more than 30 atomic % of Co is further added can also be used.

In the present invention, since a melted metal having a supercooled liquid temperature width $\Delta T_x$ of 35° C. or more is sprayed on the cooling body to form a ribbon-shaped glassy alloy material, and heat-treated by heating at a heating rate of 0.15 to 3° C./sec, and then cooling, it is possible to overcome the limit to the thickness of a conventional amorphous alloy ribbon, and obtain a glassy alloy which can be provided in a bulk shape and which has soft magnetic properties at room temperature.

In heat treatment, the holding temperature is preferably in the range of the glass transition temperature and the crystallization temperature, the holding time is preferably 10 to 60 minutes, and the cooling rate is preferably 0.02 to 500° C./sec. Under these conditions, it is possible to securely obtain a glassy alloy having a large thickness and excellent ferromagnetism, as described above.

A preferable composition system comprises metal elements other than Fe and semimetal elements, wherein the metalloid elements added include at least one of P, C, B and Ge or at least one of P, C, B and Ge and Si, and the other metal elements include at least one of the metal elements of IIIB group and IVB group in the Periodic Table, or at least one of Al, Ga, In and Sn.

The present invention can provide a bulk ribbon-shaped glassy alloy having a thickness 20 $\mu$m or more, or 20 to 200 $\mu$m, and a thickness of 20 to 250 $\mu$m particularly when Si is added, and having soft magnetic properties at room temperature. The present invention can also provide a glassy alloy having soft magnetic properties including low coercive force and high magnetic permeability.

DESCRIPTION OF THE PREFERRED EMBODIMENTS

Figure 1:
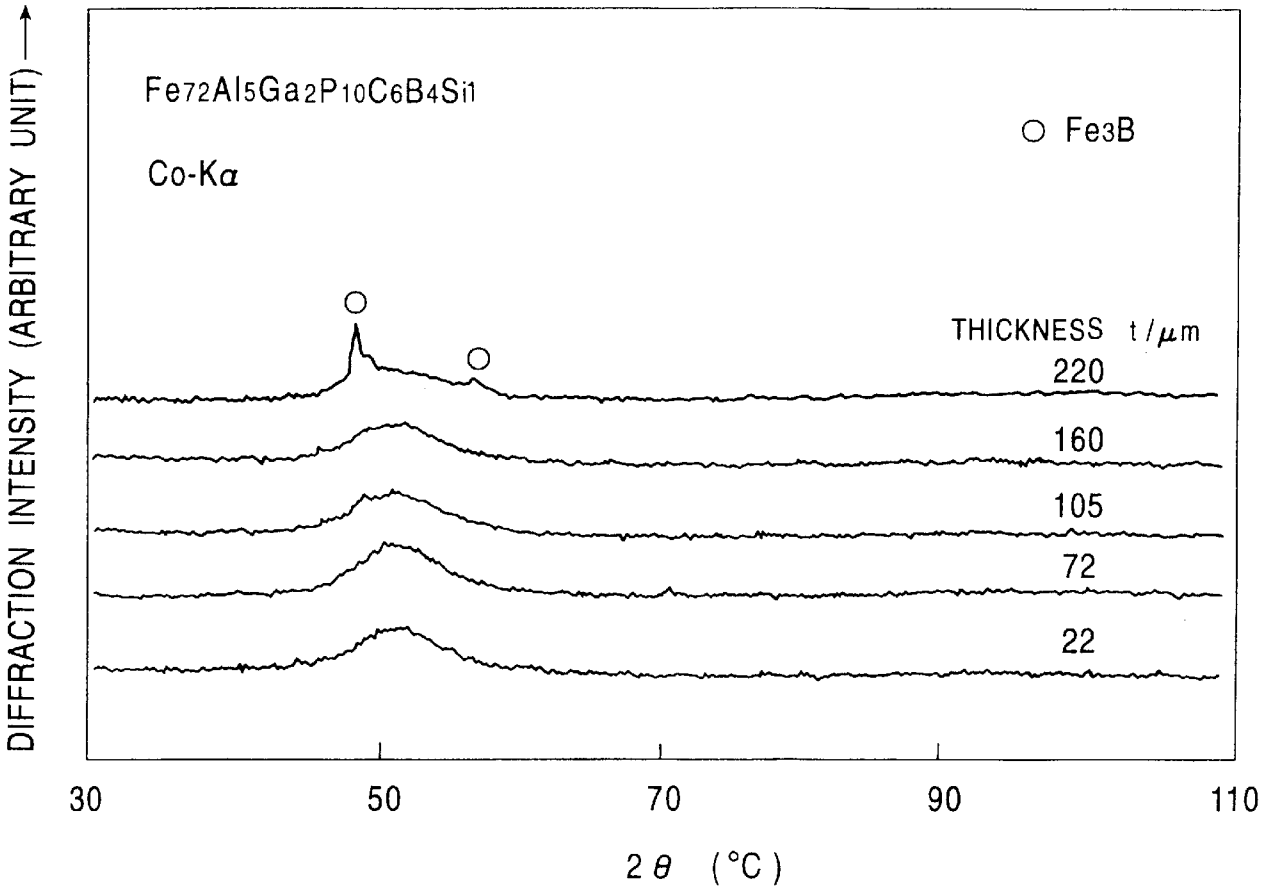
FIG. 1 is a diagram showing a X-ray diffraction pattern of a sample having a composition of the present invention and a thickness of 24 to 220 $\mu$m.

A method in accordance with an embodiment of the present invention is described below with reference to the drawings.

Before the producing method of the present invention is described, a glassy alloy to be produced by the method of the present invention and the composition thereof are described below.

As Fe-based alloys, alloys having the compositions Fe—P—C, Fe—P—B, Fe—Ni—Si—B, and the like are conventionally known as producing glass transition. However, these alloys have a supercooled liquid temperature width $\Delta T_x$ of as small as 25° C. or less, and cannot be actually formed as glassy alloys.

On the other hand, Fe-based soft magnetic glass alloys to be produced by the method of the present invention have a supercooled liquid temperature width $\Delta T_x$ of 35° C. or more, and with some compositions, the supercooled liquid temperature width $\Delta T_x$ is as large as 40 to 50° C. This is not expected from conventional known Fe-based alloys at all. Also this type of Fe-based soft magnetic glassy alloy has excellent soft magnetic properties at room temperature, and is a completely novel alloy which has not been found so far. Although only ribbon-shaped amorphous alloys could be conventionally realized, this glassy alloy can be obtained as a bulk amorphous alloy, and thus has significantly excellent practicability.

The Fe-based soft magnetic glassy alloy produced by the method of the present invention has a composition comprising Fe as a main component, and other metal elements and metalloid elements. The other metal elements can be selected from IIA group, IIIA and IIIB groups, IVA and IVB groups, VA group, VIA group and IVIIA group in the Periodic Table, and metal elements in IIIB group and IVB group are particularly preferable. For example, Al, Ga, In and Sn are preferable.

The Fe-based soft magnetic glassy alloy of the present invention may also contain at least one metal element selected from Ti, Hf, Cu, Mn, Nb, Mo, Cr, Ni, Co, Ta, W and Zr. Examples of the semimetal elements include P, C, B, Si, and Ge.

More specifically, the composition of the Fe-based glassy alloy of the present invention contains 1 to 10 atomic % or Al, 0.5 to 4 atomic % or Ga, 9 to 15 atomic % of P, 5 to 7 atomic % or C, 2 to 10 atomic % of B, and the balance comprising Fe, and it may contain inevitable impurities.

By further adding Si to the above composition system, it is possible to increase the supercooled liquid temperature width $\Delta T_x$ and the critical thickness of an amorphous single phase. As a result, it is possible to further increase the thickness of a bulk-shaped Fe-based soft magnetic glassy alloy having excellent soft magnetic properties at room temperature. Since an excessive Si content causes the glassy alloy to lose the supercooled liquid region, the S content is preferably 15% or less.

More specifically, the composition of the Fe-based glassy alloy of the present invention contains 1 to 10 atomic % or Al, 0.5 to 4 atomic % or Ga, 9 to 15% of P, 5 to 7 atomic % or C, 2 to 10 atomic % of B, 0 to 15 atomic % of Si, and the balance comprising Fe, and it may contain inevitable impurities.

The above composition may further contain 4% or less, more preferably 0.5 to 4%, of Ge.

Also the composition may further contain 7% or less of at least one of Nb, Mo, Cr, Hf, W and Zr, and 10% or less of Ni, and 30% or less of Co.

In any one of the compositions, a supercooled liquid temperature width $\Delta T_x$ of 35° C. or more can be obtained, and in some compositions, a supercooled liquid temperature width $\Delta T_x$ of 40 to 50° C. can be obtained.

The Fe-based soft magnetic glassy alloy of the present invention is produced by the method comprising quenching a melt by using a single roll or two rolls to obtain a ribbon-shaped glassy alloy material, and heat-treating the glassy alloy material. This producing method is capable of obtaining a Fe-based soft magnetic glassy alloy having a thickness and a diameter which are several times to several tens times as large as a conventional known amorphous alloy ribbon (several μm to about 20 μm).

Specifically, the heat treatment of the present invention permits an amorphous single phase state to be maintained up to a thickness of 160 μm, and good soft magnetic properties to be maintained when the thickness is more preferably 100 μm or less. In formation of a transformer core or the like, with a thickness of 50 μm or more, the lamination factor (the ratio of the alloy to the volume of the core) is significantly improved, as compared with conventional amorphous alloys. Therefore, in order to secure a single-phase amorphous alloy texture and a high lamination factor, the thickness of the glassy alloy is 24 to 160 μm, more preferably 50 to 100 μm.

The Fe-based soft magnetic glassy alloy having the above composition obtained by the method of the present invention has ferromagnetism at room temperature, and exhibits good soft magnetic properties by heat treatment.

The Fe-based soft magnetic glassy alloy is useful as a material having excellent soft magnetic properties for various applications.

Next, the method of producing the glassy alloy having the composition system is described in detail below. Although the preferable cooling rate is determined by the alloy composition, production means, the size and shape of the product, etc., a cooling rate in the range of about 1 to $10^4$° C./s can generally be considered as a measure. In fact, the cooling rate can be determined by confirming whether or not a phase of $Fe_3B$, $Fe_2B$, $Fe_3P$, or the like precipitates as a crystal phase in a glassy phase.

The glassy alloy material (ribbon) obtained by quenching a melt is heat-treated under the conditions below to obtain excellent magnetic properties.

The preferable conditions of heat treatment are described below.

In heat treatment of the glassy alloy material obtained by one of the above various quenching methods, the heating rate is within the range of 0.15° C./sec (9° C./min) to 3° C./sec (180° C./min), the heating holding temperature is within the range of the glass transition temperature (Tg) to the crystallization start temperature (Tx), the heating holding time is 10 to 60 minutes, and the cooling rate is within the range of 0.02 to 500° C./sec, preferably 0.02 to 400° C./sec, more preferably 0.02 to 300° C./sec.

Under these conditions, a heating rate of less than 10° C./min causes a problem of crystallization of the alloy material due to a too low heating rate before the intended glassy alloy is obtained, and a heating rate of over 180° C./min causes difficulties in heating due to a limit of a heating device. However, the heating rate is preferably as high as possible. With a heating holding temperature of less than the glass transition temperature ($T_g$), the effect of improving magnetic properties is insufficient, and with a heating holding temperature higher than the crystallization temperature ($T_x$), crystallization undesirably proceeds. With a heating holding time of less than 10 minutes, heat treatment is completed before the effect of heating is exhibited, and with a heating holding time of over 60 minutes, crystallization probably proceeds.

With a cooling rate of less than 0.02° C./sec, excellent soft magnetic properties cannot undesirably be obtained because cooling is influenced by an external magnetic field such as geomagnetism or the like due to a too low cooling rate. With a cooling rate of over 500° C./sec, stress remains in the material due to thermal shock during cooling, and thus magnetic properties undesirably deteriorate.

The glassy alloy obtained by the above producing method has a resistivity of 1.5 μΩ or more and a texture mainly comprising an amorphous phase and exhibits excellent soft magnetism at room temperature.

EXAMPLES

The glassy alloy of the present invention is described in further detail below with reference to examples, but, of course, the present invention is not limited to these examples.

EXAMPLE 1

Predetermined amounts of Fe, Al and Ga, Fe—C alloy, Fe—P alloy and B as raw materials were weighed, and melted by a high frequency induction heating device in an Ar atmosphere under reduced pressure to prepare ingots respectively having the atomic composition $Fe_{73}Al_5Ga_2P_{10}C_5B_4Si_1$ and $Fe_{72}Al_5Ga_2P_{10}C_6B_4Si_1$.

Each of the ingots was placed in a crucible, melted, and quenched by a single roll method comprising spraying on a rotating copper roll from a nozzle of the crucible to obtain a ribbon in an Ar atmosphere under reduced pressure. In production, when the nozzle diameter was set to 0.41 mm or 0.42 mm, the distance (gap) between the nozzle tip and the roll surface was set to 0.3 to 0.6 mm, the rotational speed of the roll was set to 250 to 1500 rpm, the injection pressure was set to 0.30 to 0.4 kgf/cm$^2$, and the atmospheric pressure was set to −10 mmHg, ribbon-shaped alloy materials respectively having thicknesses of 24 μm, 56 μm, 110 μm, 160 μm, and 220 μm were obtained.

FIG. 1 shows the X-ray diffraction pattern of each of the ribbon samples respectively having the thicknesses and produced as described above.

The X-ray diffraction patterns shown in FIG. 1 reveal that all samples having thicknesses 24 to 160 μm show halo patterns and have an amorphous single phase texture. It is also found that the sample having a thickness of 220 μm shows a $Fe_3B$ peak but has a texture mainly comprising an amorphous phase.

The above results indicate that the single roll method of producing an alloy having the composition according to the present invention can obtain a ribbon-shaped glassy alloy material having a thickness in the range of 24 to 160 μm, and an amorphous single phase texture.

As a result of differential scanning calorimetry of each of the samples, the sample having the atomic composition $Fe_{73}Al_5Ga_2P_{10}C_5B_4Si_1$ had a glass transition temperature ($T_g$) of 754° K and a crystallization temperature ($T_x$) of 805° K, and the sample having the atomic composition $Fe_{72}Al_5Ga_2P_{10}C_6B_4Si_1$ had a glass transition temperature ($T_g$) of 762° K and a crystallization temperature ($T_x$) of 820° K.

Figure 2:
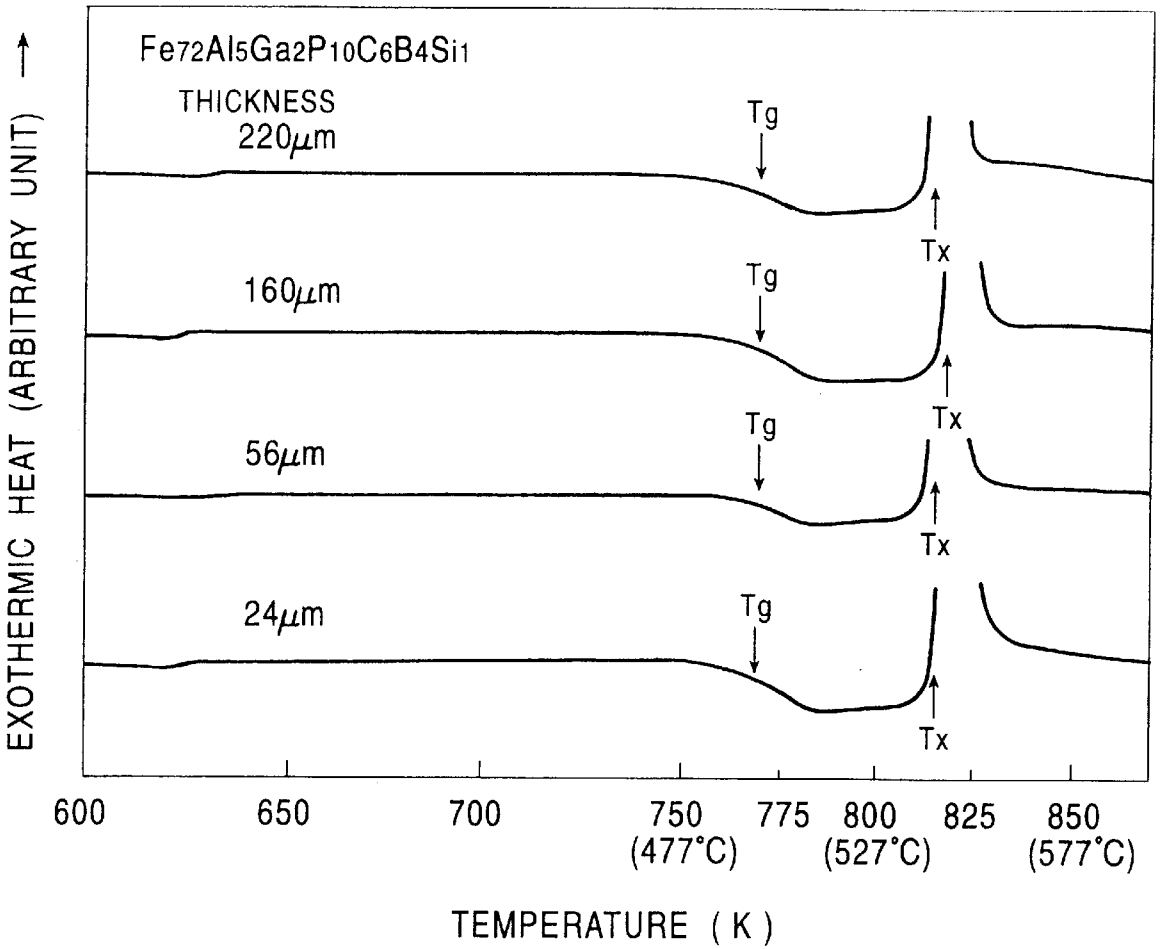
FIG. 2 is a diagram showing a DSC curve of a sample having a composition of the present invention and a thickness of 24 to 220 μm.

FIG. 2 shows the DSC (differential scanning calorimetry) curve (a heating rate of 0.67° C./sec) of each of the samples obtained as described above. FIG. 2 indicates that all samples have a wide supercooled liquid region below the crystallization temperature, and the supercooled liquid temperature width $\Delta T_x$, which is expressed by the formula $\Delta T_x = T_x - T_g$ (wherein $T_x$ indicates the crystallization temperature, and $T_g$ indicates the glass transition temperature) is close to 50° C. and exceeds 35° C.

Figure 3:
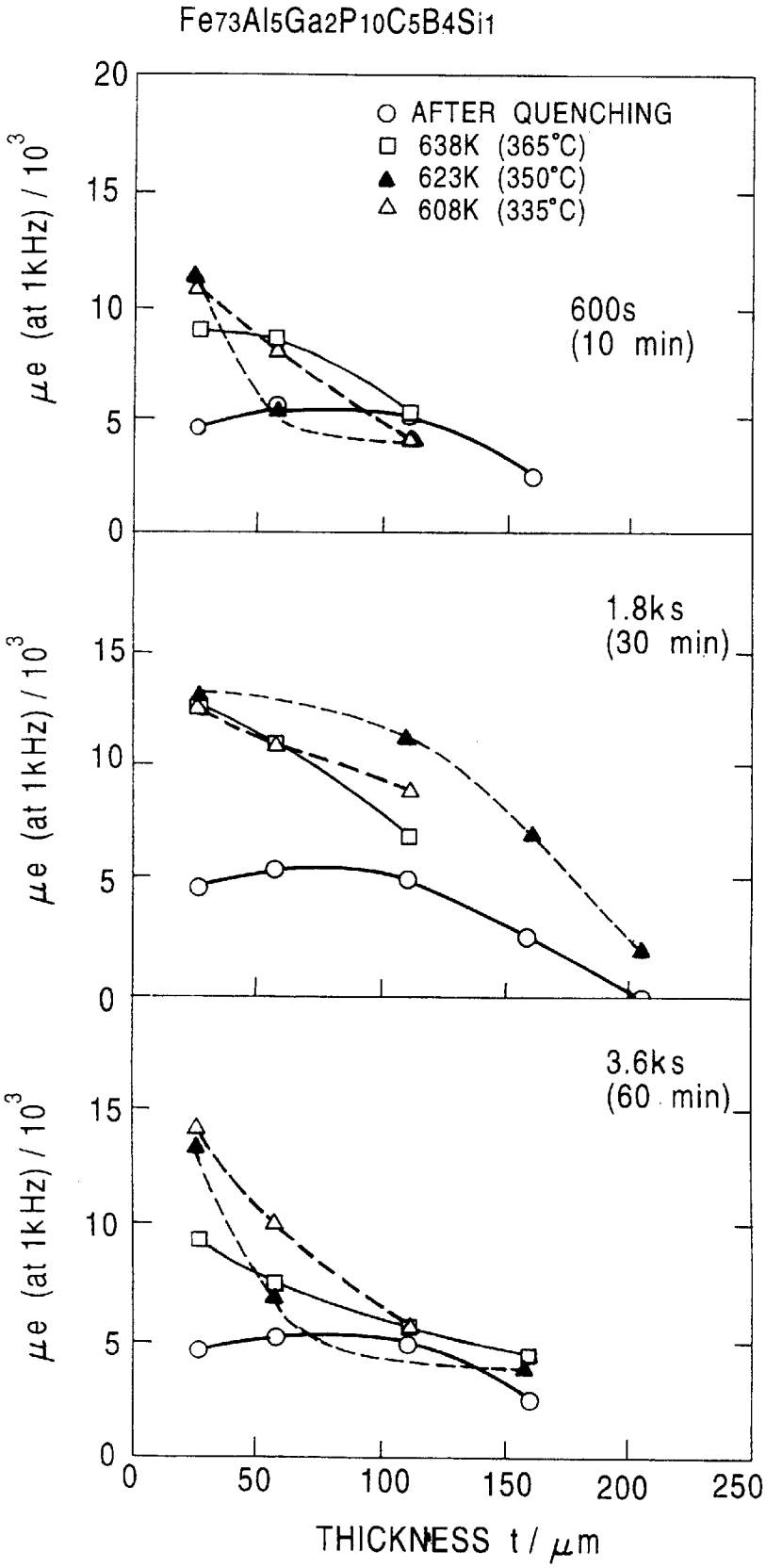
FIG. 3 is a diagram showing the results of measurement of the dependence of effective magnetic permeability μe (1 kHz) on the thickness of a sample having the composition $Fe_{73}Al_5Ga_2P_{10}C_5B_4Si_1$ obtained under each of heat treatment conditions.
Figure 4:
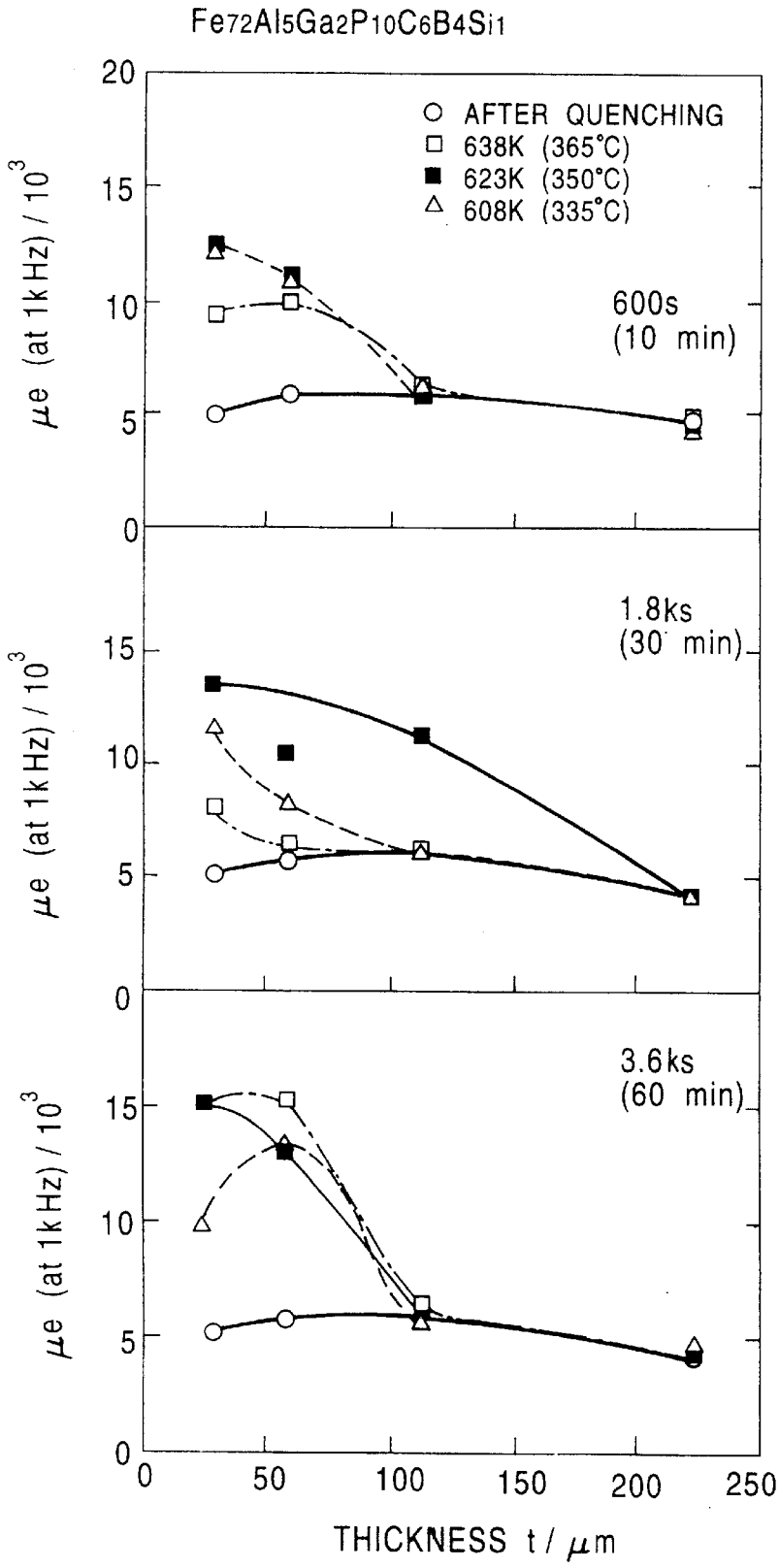
FIG. 4 is a diagram showing the results of impedance analyzer measurement of the dependence of effective magnetic permeability μe (1 kHz) on the thickness of a sample having the composition $Fe_{72}Al_5Ga_2P_{10}C_6B_4Si_1$ obtained under each of heat treatment conditions.

FIG. 3 shows the results of measurement of the dependence of effective magnetic permeability (1 kHz) on the thickness of a sample having the composition $Fe_{73}Al_5Ga_2P_{10}C_5B_4Si_1$ obtained under each of heat treatment conditions. FIG. 4 shows the results of impedance analyzer measurement of the dependence of effective magnetic permeability (1 kHz) on the thickness of a sample having the composition $Fe_{72}Al_5Ga_2P_{10}C_6B_4Si_1$ obtained under each of heat treatment conditions.

The results shown in FIGS. 3 and 4 indicate that in all the sample after quenching, the sample after heat treatment at 335° C., the sample after heat treatment at 350° C., and the sample after heat treatment at 365° C., high effective permeability is obtained up to a thickness of 24 to 100 μm, and even in the thickness region of 100 to 220 μm, practically sufficient magnetic permeability is obtained. For these samples, the heating rate was 0.2° C./sec, and the cooling rate was 0.1° C./sec.

The results shown in FIGS. 3 and 4 also indicate that for Fe—Al—Ga—P—C—B—Si system samples, the most preferable heat treatment conditions include a temperature of 350° C., a holding time of 30 minutes, and a cooling rate of 0.1° C./sec.

Figure 5:
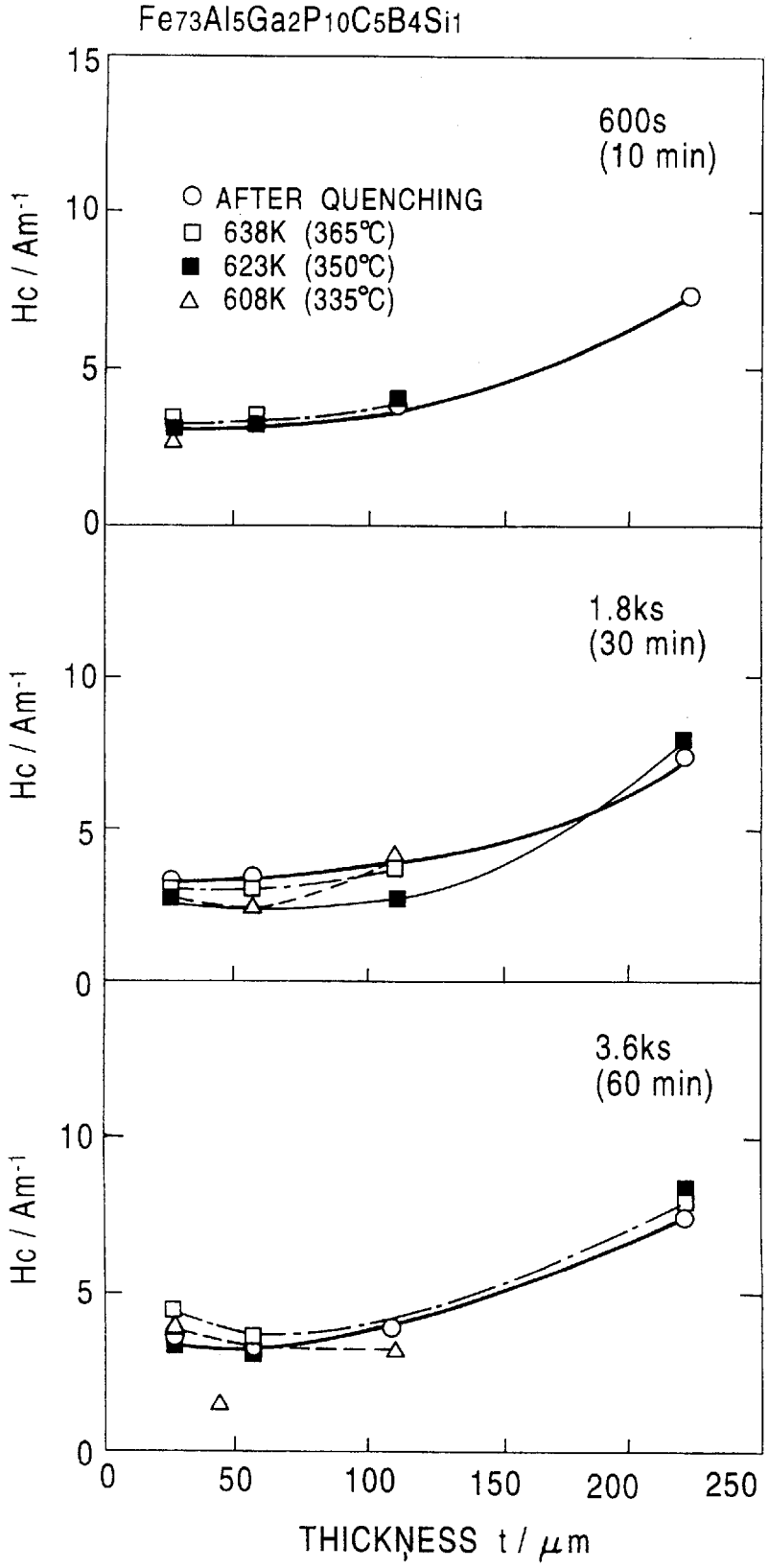
FIG. 5 is a diagram showing the results of measurement of the dependence of coercive force on the thickness of a sample having the composition $Fe_{73}Al_5Ga_2P_{10}C_5B_4Si_1$ obtained under each of heat treatment conditions.
Figure 6:
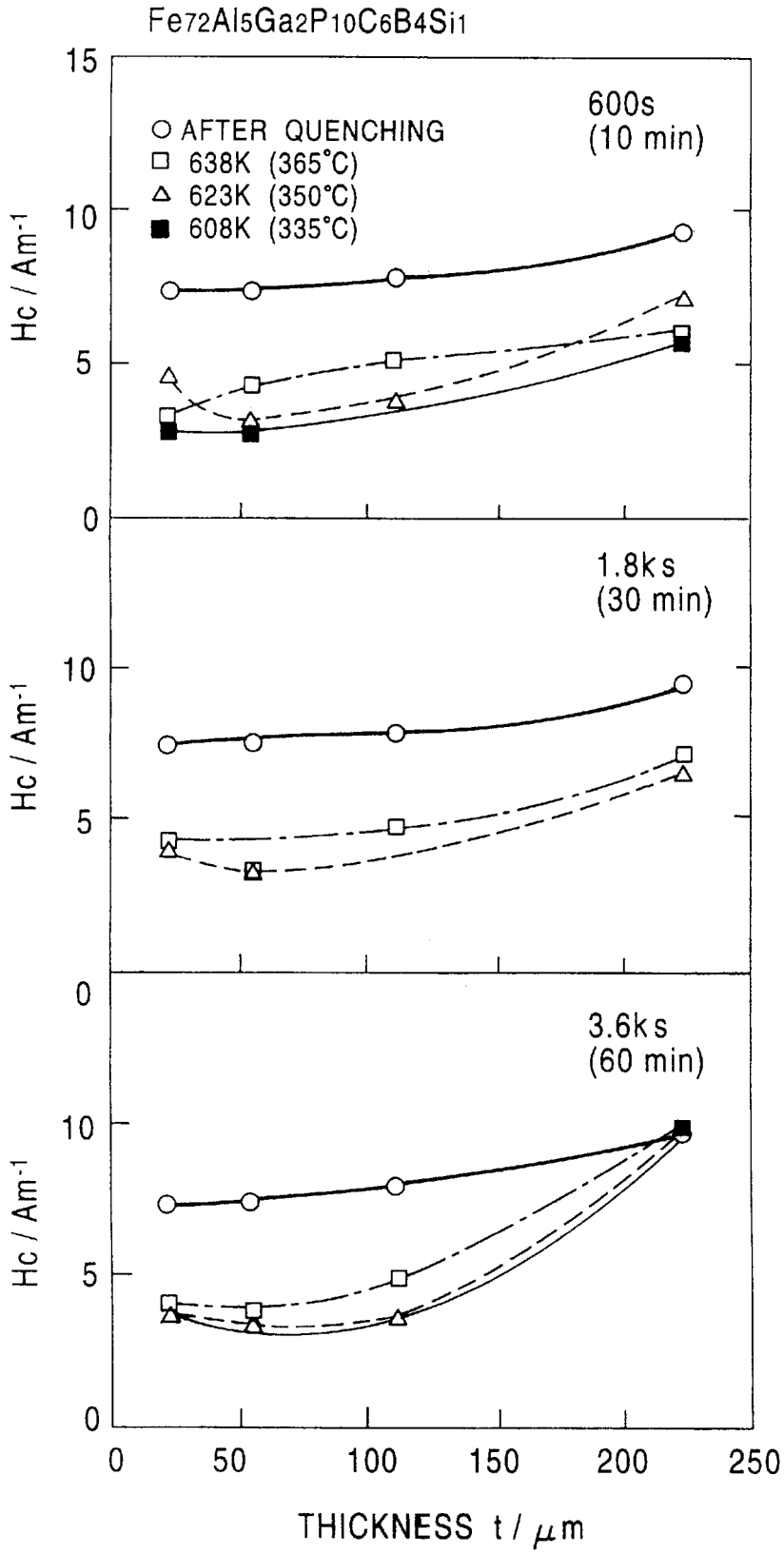
FIG. 6 is a diagram showing the results of B—H tracer measurement of the dependence of coercive force on the thickness of a sample having the composition $Fe_{72}Al_5Ga_2P_{10}C_5B_4Si_1$ obtained under each of heat treatment conditions.
Figure 7:
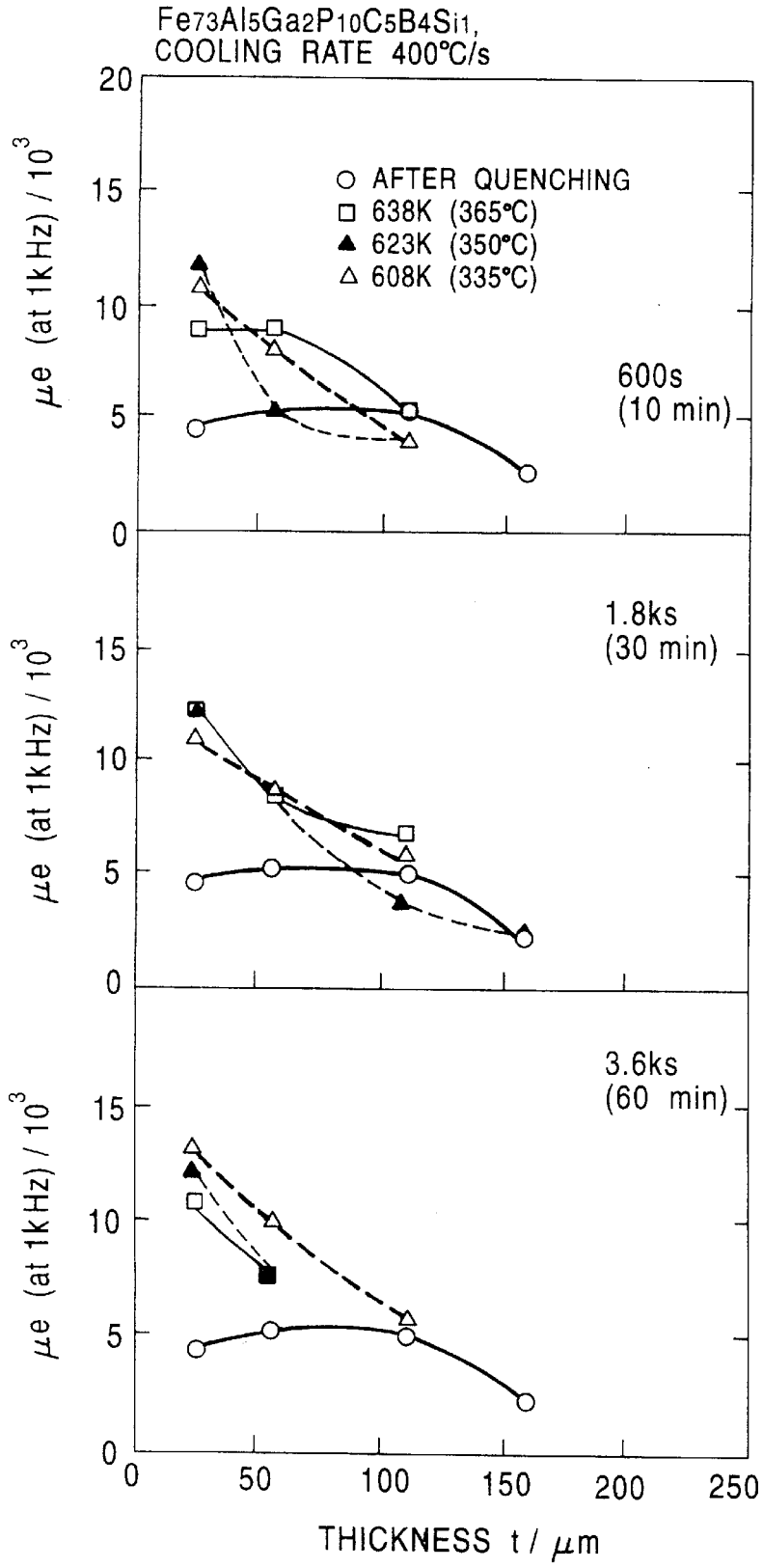
FIG. 7 is a diagram showing the results of measurement of the dependence of effective magnetic permeability μe (1 kHz) on the thickness of a sample having the composition $Fe_{73}Al_5Ga_2P_{10}C_5B_4Si_1$ obtained under each of heat treatment conditions including a cooling rate of 400° C./sec.
Figure 8:
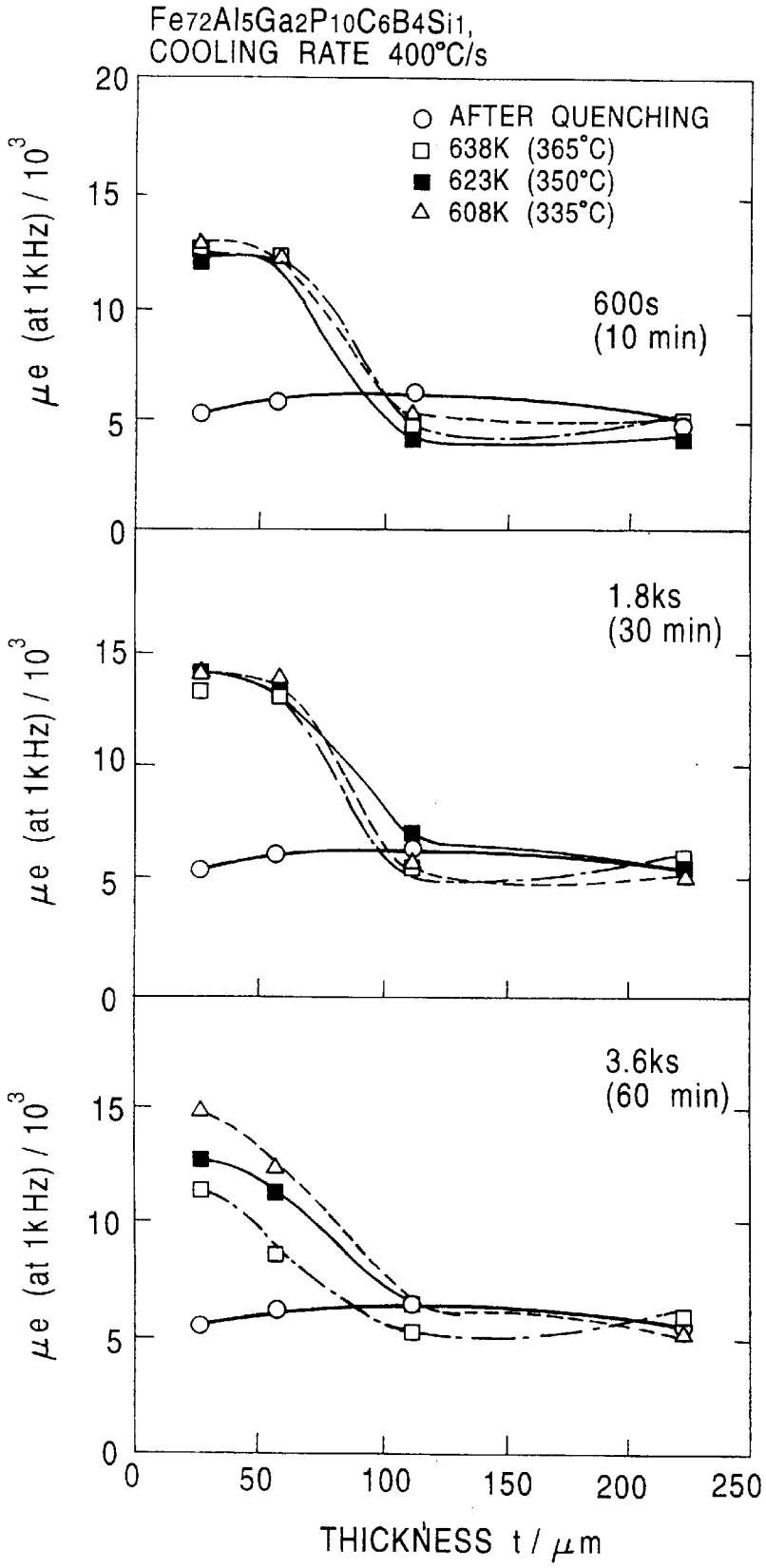
FIG. 8 is a diagram showing the results of impedance analyzer measurement of the dependence of effective magnetic permeability μe (1 kHz) on the thickness of a sample having the composition $Fe_{72}Al_5Ga_2P_{10}C_6B_4Si_1$ obtained under each of heat treatment conditions including a cooling rate of 400° C./sec.
Figure 9:
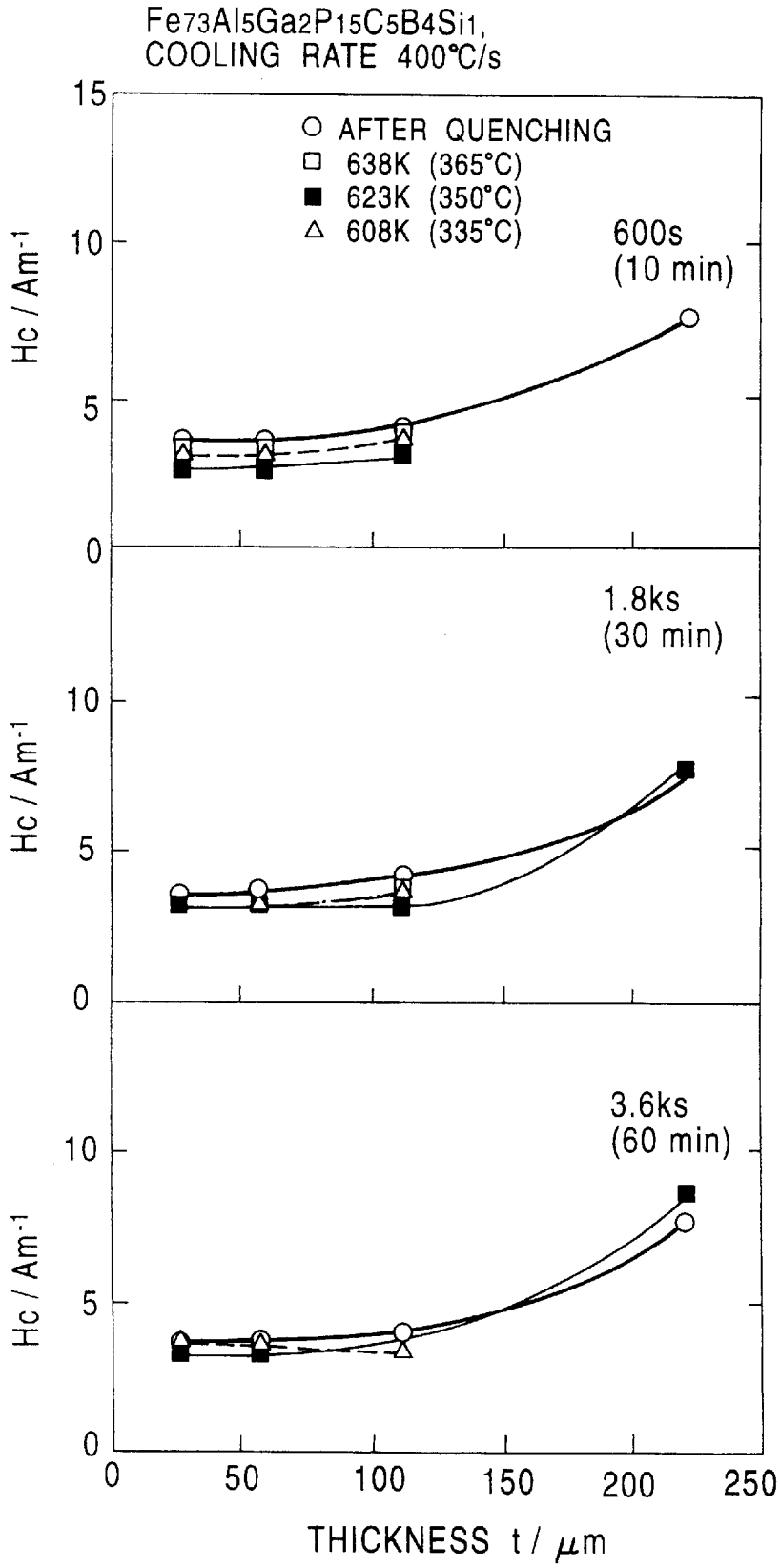
FIG. 9 is a diagram showing the results of measurement of the dependence of coercive force on the thickness of a sample having the composition $Fe_{73}Al_5Ga_2P_{10}C_5B_4Si_1$ obtained under each of heat treatment conditions including a cooling rate of 400° C./sec.
Figure 10:
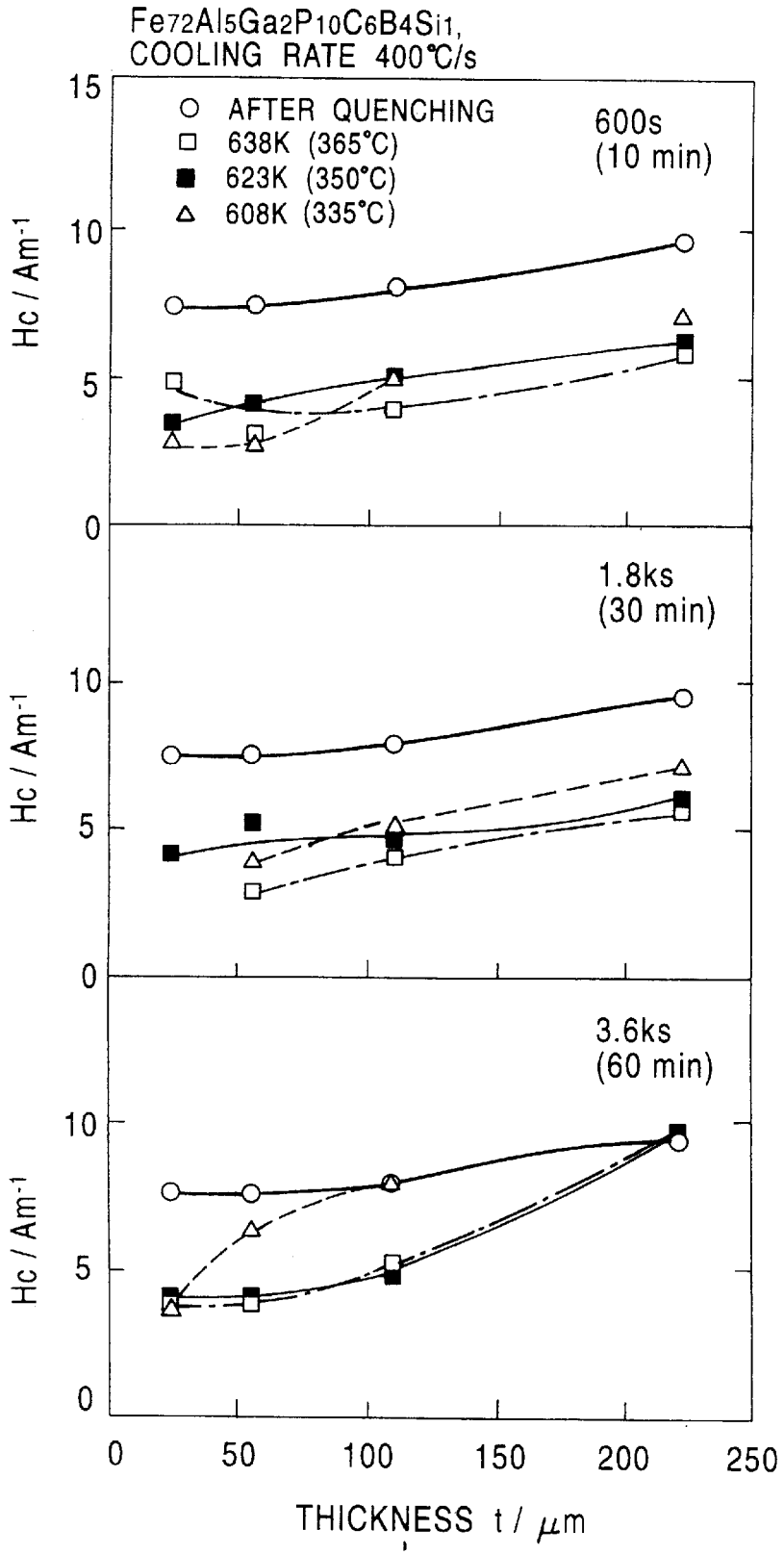
FIG. 10 is a diagram showing the results of B—H tracer measurement of the dependence of coercive force on the thickness of a sample having the composition $Fe_{72}Al_5Ga_2P_{10}C_6B_4Si_1$ obtained under each of heat treatment conditions including a cooling rate of 400° C./sec.

FIG. 5 shows the results of measurement of coercive force on the thickness of a sample having the composition $Fe_{73}Al_5Ga_2P_{10}C_5B_4Si_1$ obtained under each of heat treatment conditions. FIG. 6 shows the results of B—H tracer measurement of coercive force on the thickness of a sample having the composition $Fe_{72}Al_5Ga_2P_{10}C_6B_4Si_1$ obtained under each of heat treatment conditions. For these samples, the heating rate was 0.2° C./sec, and the cooling rate was 0.1° C./sec.

The results shown in FIGS. 5 and 6 indicate that in all samples, the coercive force tends to increase as the thickness increases, and that with the composition $Fe_{73}Al_5Ga_2P_{10}C_5B_4Si_1$, all the sample after heat treatment at 335° C. and the sample after heat treatment at 350° C. and the sample after heat treatment at 365° C. show low coercive force equivalent to the sample after quenching over the whole thickness range, and with the composition $Fe_{72}Al_5Ga_2P_{10}C_6B_4Si_1$, all the samples show coercive force lower than the sample after quenching over the whole thickness range.

In the present invention, at a cooling rate of over 500° C./sec, rapid cooling introduces strain into an alloy due to thermal shock, resulting in an undesirable decrease in the effect of improving properties. Also the glassy alloy of the present invention is amorphous, but internal stress probably acts due to solid solution of C in Fe.

FIGS. 7 to 10 show the results of measurement of the dependence of effective magnetic permeability and coercive force on the thickness of each of samples respectively having the compositions $Fe_{73}Al_5Ga_2P_{10}C_5B_4Si_1$ and $Fe_{72}Al_5Ga_2P_{10}C_6B_4Si_1$ obtained under the same heat treatment conditions as the samples shown in FIGS. 3 to 6 except a cooling rate of 400° C./sec.

The results shown in FIGS. 7 to 10 indicate that like in the measurement samples shown in FIGS. 3 to 6, the samples after heat treatment at a cooling rate of 400° C./sec have good soft magnetic properties.

As a result of measurement of resistivity of a sample of $Fe_{73}Al_5Ga_2P_{11}C_5B_4$ having a thickness of 100 $\mu$m and produced by the same method as the above example, a value of as high as 1.7 $\mu\Omega$m was obtained. Therefore, in the glassy alloy produced by the producing method of the present invention, an eddy current loss can be deceased even if the thickness is increased.

What is claimed is:

1. A method of producing a glassy alloy comprising:

spraying, onto a moving cooling body, a melted metal alloy composition having a supercooled liquid temperature width $\Delta Tx$ of not less than 35° C., which is expressed by the equation $\Delta Tx = Tx - Tg$ wherein Tx indicates a crystallization temperature, and Tg indicates a glass transition temperature, to form a ribbon-shaped glassy alloy material; and heat-treating the glassy alloy material by heating the glassy alloy material at a heating rate of 0.15 to 3° C./sec to a heating temperature in a range between the crystallization temperature and the glass transition temperature and then cooling the glassy alloy material at a cooling rate of 0.02 to 500° C./sec, said glassy alloy material comprising, in atomic percent: 1–10% Al, 0.5–4% Ga, 9–15% P, 5–7% C, 2–10% B, 0–15% Si and the balance Fe.

2. A method of producing a glassy alloy according to claim 1, wherein the composition of the glassy alloy further contains greater than 0 and less than 4 atomic % of Ge.

3. A method of producing a glassy alloy according to claim 1, wherein the composition of the glassy alloy further contains greater than 0 and less than 7 atomic % of at least one of Nb, Mo, Hf, Ta, W, Zr, and Cr.

4. A method of producing a glassy alloy according to claim 1, wherein the composition of the glassy alloy further contains at least one of greater than 0 and less than 10 atomic % of Ni and greater than 0 and less than 30 atomic % of Co.

5. A method of producing a glassy alloy according to claim 1, wherein in the heat treatment, the heating temperature is maintained for 10 to 60 minutes.

6. A method of producing a glassy alloy according to claim 1, wherein the composition of the glassy alloy further contains greater than 0 and less than 30 atomic % of Co.

7. A method of producing a glassy alloy according to claim 1, wherein a thickness of the ribbon-shaped glassy alloy material is between 50 and 100 $\mu$m.

* * * * *